United States Patent [19]

Brown et al.

[11] Patent Number: 4,623,068

[45] Date of Patent: Nov. 18, 1986

[54] NIPPLE ASSEMBLY

[75] Inventors: John M. Brown; Donald W. Herritz, both of Reedsburg, Wis.; Barbara L. Ottinger, Newaygo, Mich.; Leland D. Westmas, Reedsburg, Wis.

[73] Assignee: Gerber Products Company, Fremont, Mich.

[21] Appl. No.: 767,233

[22] Filed: Aug. 19, 1985

Related U.S. Application Data

[63] Continuation of Ser. No. 446,845, Dec. 6, 1982, abandoned.

[51] Int. Cl.[4] ..... A61J 9/08; A61J 11/04

[52] U.S. Cl. ..... 215/11 R; 215/11 C

[58] Field of Search ..... 215/11 R–11 E

[56] References Cited

U.S. PATENT DOCUMENTS

| | | | |
|---|---|---|---|
| 224,557 | 2/1880 | Potter | 215/11 R |
| 1,998,646 | 4/1935 | Yager | 215/11 B |
| 2,025,508 | 12/1935 | Herstein | 215/11 R |
| 2,093,730 | 9/1937 | Kurkjian | 215/11 R |
| 2,588,991 | 3/1952 | Schellin | 215/11 R |
| 2,811,271 | 10/1957 | Kurkjian | 215/11 R |
| 2,889,064 | 6/1959 | Kurkjian | 215/11 R |
| 2,956,702 | 10/1960 | Ransom | 215/11 R |
| 2,960,088 | 11/1960 | Witz | 215/11 R X |
| 2,982,432 | 5/1961 | Mehl | 215/11 R |
| 2,987,208 | 6/1961 | Ransom | 215/11 R |
| 3,126,116 | 3/1964 | Clinehens | 215/11 R |
| 3,544,281 | 12/1970 | Phillips | 215/274 X |
| 3,549,036 | 12/1970 | Ritsi | 215/11 C |
| 3,858,738 | 1/1975 | Hurst | 215/11 C |
| 3,946,888 | 3/1976 | Tonkin | 215/11 D X |
| 4,238,040 | 12/1980 | Fitzpatrick | 215/11 E |

FOREIGN PATENT DOCUMENTS

| | | | |
|---|---|---|---|
| 150789 | 4/1904 | Fed. Rep. of Germany | 215/274 |
| 2364102 | 7/1974 | Fed. Rep. of Germany | 215/11 R |

*Primary Examiner*—William Price
*Assistant Examiner*—Sue A. Weaver
*Attorney, Agent, or Firm*—Townsend and Townsend

[57] ABSTRACT

A collar 10 and hood 30 are disclosed for use with a standard baby bottle and nipple. The collar has a beveled flange 14 which recesses the joint between the collar and nipple, making the joint less accessible and less likely to pinch a baby's lips.

1 Claim, 6 Drawing Figures

NIPPLE ASSEMBLY

This is a continuation of application Ser. No. 446,845, filed Dec. 6, 1982, now abandoned.

BACKGROUND OF THE INVENTION

1. Field of the Invention

This invention relates to baby bottle collar, hood, and nipple assemblies, and specifically to a non lip-pinching collar.

2. Description of the Prior Art

Collar, hood, and nipple assemblies for dispensing milk or formula from baby bottles or jars are well-known. A previous type of collar had a flange which was sloped from its periphery up to the nipple. This raised the nipple from the collar, but the angle at the joint between the base of the nipple and the collar was relatively accessible to a baby's lips. Another type of collar has a planar flange and, around the center hole, a raised rim for snapping on a hood. With either type of collar, a baby sucking on the nipple could get its lips pinched between the nipple and the collar.

SUMMARY OF THE INVENTION

It is therefore an object of this invention to provide a baby bottle collar which when used with a nipple will not pinch a baby's lips. This is accomplished by beveling the collar flange down to recess the joint between the collar and the nipple. With the joint being less accessible, the baby's lips will not as easily work their way in.

DETAILED DESCRIPTION OF THE PREFERRED EMBODIMENT

Figure 1:
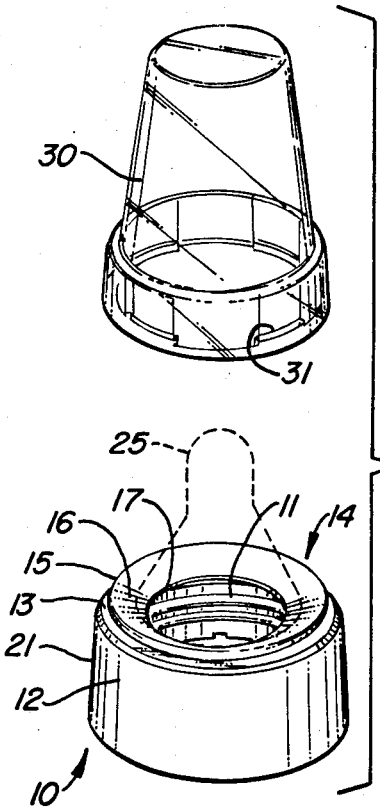
FIG. 1 is an exploded perspective view of a collar according to this invention with a nipple shown in phantom outline and a hood.
Figure 2:
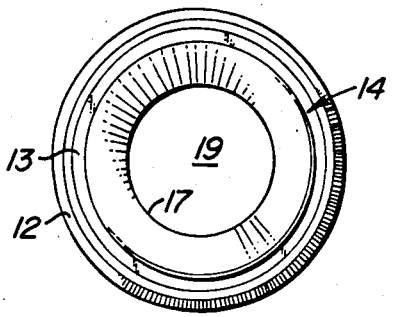
FIG. 2 is a top plan view of the collar.
Figure 3:
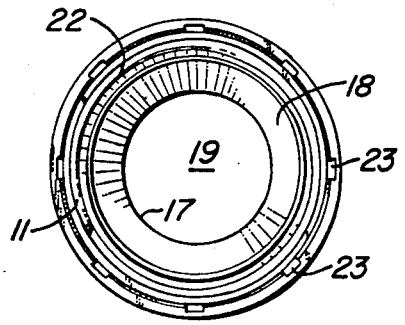
FIG. 3 is a bottom plan view of the collar.
Figure 6:
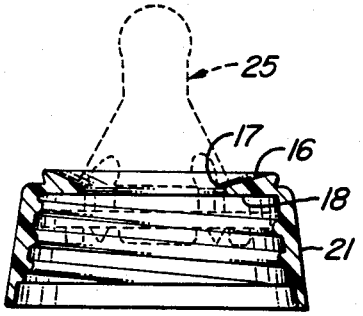
FIG. 6 is an elevated cross-sectional view of the collar.
Figure 4:
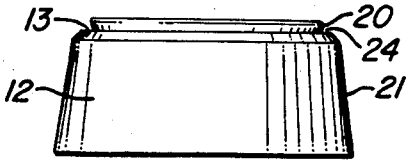
FIG. 4 is a side elevational view of the collar.
Figure 5:
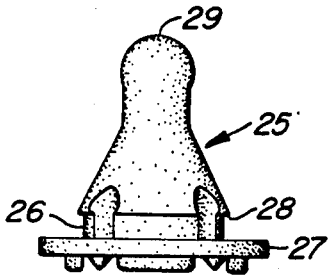
FIG. 5 is a side elevational view of a nipple.

The collar 10 of the present invention is shown in FIG. 1 with a nipple 25 in broken lines and a hood 30 above the collar and nipple. Collar 10 and hood 30 are typically made from injection molded plastic such as polypropylene or other boilable material, that can be sterilized before use. Collar 10 comprises a skirt 12 the outside of which forms a first conical section 21. Standard screw threads 11 on the inside 22 of skirt 12 hold the collar on an ordinary baby bottle, now shown or claimed.

A second conical surface or bevel 16 forming the top of flange 14 slops downwardly from the intersection 13 of conical section 21 and the flange's outer periphery 15 to its inner periphery 17. This bevel recesses the joint between the collar and the nipple, making the joint less accessible and less likely to pinch a baby's lip.

A rubber nipple 25 as described in U.S. Pat. No. 2,960,088 is used with the collar. However, any standard nipple may be used. The nipple 25 is inserted tip 29 first through the open base 19 of the collar, and pushed through the hole in flange 14 defined by inner periphery 17 until the shoulder 28 of the nipple rests on the upper surface of flange inner periphery 17, which may be rounded to reduce wear on the adjacent area 26 of nipple 25. The top of nipple base 27 abuts against the planar underside 18 of the flange.

Using standard thread 11 inside the collar as in FIG. 1, the collar 10 is then screwed onto an ordinary baby bottle or food jar until the base 27 of the nipple is compressed and seated against the rim of the bottle. The flow of liquid through nipple 25 can be altered by tightening or loosening collar 10. The baby sucks liquid through the nipple in the normal manner, except that the possibility of a lip working in and being pinched between nipple shaft 26 and flange inner periphery 17 is practically eliminated. A hood 30 is provided to catch liquid leaking from tip 29, if the bottle has to be stored or carried before it has been emptied. The hood functions in a conventional manner and snaps onto the collar by means of a ridge 31 on the inside of its opening.

Prior art collars are provided with a hood-engaging rim around the flange center hole, but the rim was necessarily raised above the flange thereby making the joint between the flange and nipple more accessible, contrary to the intent of the present invention. The present invention provides an indentation 24 around the intersection 13 between conical section 21 and flange outer periphery 15. The base of the hood 30 for the collar of this invention is increased in size to the diameter of the flange, and the ridge inside the hood snaps onto a complementary lip 20 on the collar created by indentation 24. Notches 23 may be provided around the bottom of the inside 22 of the skirt so that the collar can be screwed down to lock on a baby bottle having projections complementary to the notches.

A preferred embodiment has been illustrated in detail, of which modifications and adaptations will occur to those skilled in the art. However, it is to be understood that such modifications and adaptations are within the spirit and scope of the present invention, as limited only by the following claims.

We claim:

1. A nursing bottle collar including a conically shaped internally threaded skirt portion for attachment to a correspondingly threaded bottle and a flange portion surrounding a central aperture, said collar adapted for holding a nipple formed with an upper lip-engaging shoulder of a diameter less than the diameter of said collar and a bottle-engaging flange of a diameter intermediate said collar diameter and said upper shoulder diameter;

the improvement comprising said flange portion being formed with a downwardly and inwardly bevelled top surface and a planar bottom surface, whereby when said nipple is disposed through said central aperture and a nursing bottle is threadably attached to said collar, said bottle-engaging flange is compressed to cause said lip-engaging shoulder to be drawn against said flange portion immediately adjacent the perimeter of said central aperture, thereby forming an obtuse angle to prevent a child's lip from being squeezed between said flange portion and said lip-engaging shoulder.

* * * * *